US008235109B2

(12) United States Patent
Vaeth et al.

(10) Patent No.: US 8,235,109 B2
(45) Date of Patent: Aug. 7, 2012

(54) INSTRUMENT CENTRALIZER CONFIGURABLE FOR USE WITH CEMENT EVALUATION WELL LOGGING INSTRUMENTS

(75) Inventors: John Vaeth, Slidell, LA (US); Dennis Molaison, Thibodaux, LA (US); Pavel Shaposhnikov, Houma, LA (US); Chris Babin, New Orleans, LA (US)

(73) Assignee: Schlumberger Technology Corporatio, Sugar Land, TX (US)

( * ) Notice: Subject to any disclaimer, the term of this patent is extended or adjusted under 35 U.S.C. 154(b) by 161 days.

(21) Appl. No.: 12/567,140

(22) Filed: Sep. 25, 2009

(65) Prior Publication Data

US 2010/0084144 A1 Apr. 8, 2010

Related U.S. Application Data

(60) Provisional application No. 61/100,435, filed on Sep. 26, 2008.

(51) Int. Cl.
*E21B 17/10* (2006.01)

(52) U.S. Cl. ..... 166/241.6; 166/241.5; 33/544.3

(58) Field of Classification Search .... 166/241.6–241.7, 166/196, 250.01, 241.5; 175/320, 325.1, 175/325.5–325.6; 33/544.3
See application file for complete search history.

(56) References Cited

U.S. PATENT DOCUMENTS

| | | | | |
|---|---|---|---|---|
| 3,978,924 | A * | 9/1976 | Roesner | 166/241.5 |
| 5,261,488 | A * | 11/1993 | Gullet et al. | 166/241.7 |
| 5,638,337 | A * | 6/1997 | Priest | 367/27 |
| 5,797,453 | A * | 8/1998 | Hisaw | 166/117.5 |
| 6,457,519 | B1 * | 10/2002 | Buytaert | 166/241.6 |
| 6,898,994 | B2 | 5/2005 | Walton | |
| 6,920,936 | B2 | 7/2005 | Sheiretov et al. | |

* cited by examiner

*Primary Examiner* — Giovanna Wright
(74) *Attorney, Agent, or Firm* — Stephanie Chi; Matthias Abrell; Darla Fonseca

(57) ABSTRACT

A centralizer for a well logging instrument includes a mandrel, a plurality of bow springs arranged circumferentially about the exterior surface of the mandrel and a biasing device in contact with one longitudinal end of each bow spring. The biasing device is configured to apply longitudinal biasing force to the longitudinal end of the respective bow spring.

17 Claims, 3 Drawing Sheets

2
1
RECORDING
UNIT
3
4
5
6
10
7
10
9

INSTRUMENT CENTRALIZER CONFIGURABLE FOR USE WITH CEMENT EVALUATION WELL LOGGING INSTRUMENTS

CROSS-REFERENCE TO RELATED APPLICATIONS

Priority is claimed from U.S. Provisional Application No. 61/100,435 filed on Sep. 26, 2008.

STATEMENT REGARDING FEDERALLY SPONSORED RESEARCH OR DEVELOPMENT

Not applicable.

BACKGROUND OF THE INVENTION

1. Field of the Invention

The invention relates generally to the field of well logging instruments. More specifically, the invention relates to devices used to position well logging instruments as precisely as possible in the center of a conduit or casing disposed in a subsurface wellbore, or in the center of the wellbore itself when no casing is used.

2. Background Art

Well logging instruments known in the art include an instrument used to provide services under the mark USI-ULTRASONIC IMAGER TOOL, which is a mark commonly owned with the assignee of the present invention. The foregoing instrument, among others, is inserted into a pipe or casing cemented in place in a wellbore drilled through subsurface rock formations. Information obtained from the instrument is used to evaluate the quality of the cement disposed in an annular space between the exterior of the casing and the wall of the wellbore. As is known in the art, the cement is intended to hydraulically isolate the formations outside the casing from each other and to externally seal the casing in the wellbore.

Instruments such as the foregoing USI instrument emit pulses of acoustic energy, typically at frequencies of 100 KHz and above, and detect reflected acoustic energy. The transmitting acoustic pulses and receiving reflected energy may be performed using a single transducer disposed on a device which rotates the transducer about the longitudinal axis of the instrument. Condition of the cement may be inferred by the amplitude and wave characteristics of the detected acoustic energy, and because such emission and detection is performed using a rotating transducer, the evaluation may be circumferentially differentiated.

Accurate evaluation of the cement condition using acoustic devices such as the USI instrument described above, however, requires that the instrument is disposed as closely as possible in the center of the casing. In the case of the foregoing USI instrument, having the instrument be disposed more than about 0.15 inches from the center of the casing results in lower quality of ultrasonic transit time data that generates the basis for acoustic impedance curves and color graphics for the cement map generated from the reflected acoustic signals. The signals can become essentially uninterpretable when the tool eccentering exceeds about 0.30 inches. As a general rule (not that this rule is actually dependent on casing O.D. and casing weight) the maximum eccentering that can be tolerated with the USI instrument may be defined by following expression:

$$\text{Eccentering Limit (inches)}=(0.1)*(\text{thickness})*(\text{Casing O.D.})$$

The USI instrument, as is the case for many other cement evaluation instruments, uses bowsprings to urge the instrument into the center of the wellbore casing. The effectiveness of such bowsprings depends on, among other factors, the spring rate, the number of springs, the weight of the instrument and the inclination of the wellbore from vertical. Beyond a certain point, it is impracticable to increase the spring rate of bowsprings or their number with respect to any particular size and weight well logging instrument.

It is desirable to have a device to increase the effectiveness of bowspring centralizers without the need to increase the spring rate of the bowsprings, the number of bowsprings or the size of the bowsprings.

SUMMARY OF THE INVENTION

A centralizer for a well logging instrument according to one aspect of the invention includes a mandrel, a plurality of bow springs arranged circumferentially about the exterior surface of the mandrel and a biasing device in contact with one longitudinal end of each bow spring. The biasing device is configured to apply longitudinal biasing force to the longitudinal end of the respective bow spring.

A method for well logging according to another aspect of the invention includes moving a well logging instrument along the interior of a wellbore. The well logging instrument includes at least one centralizer having a plurality of bow springs disposed circumferentially about the instrument. The method includes applying a longitudinal biasing force to one end of each of the bow springs.

Other aspects and advantages of the invention will be apparent from the following description and the appended claims.

DETAILED DESCRIPTION

Figure 1:
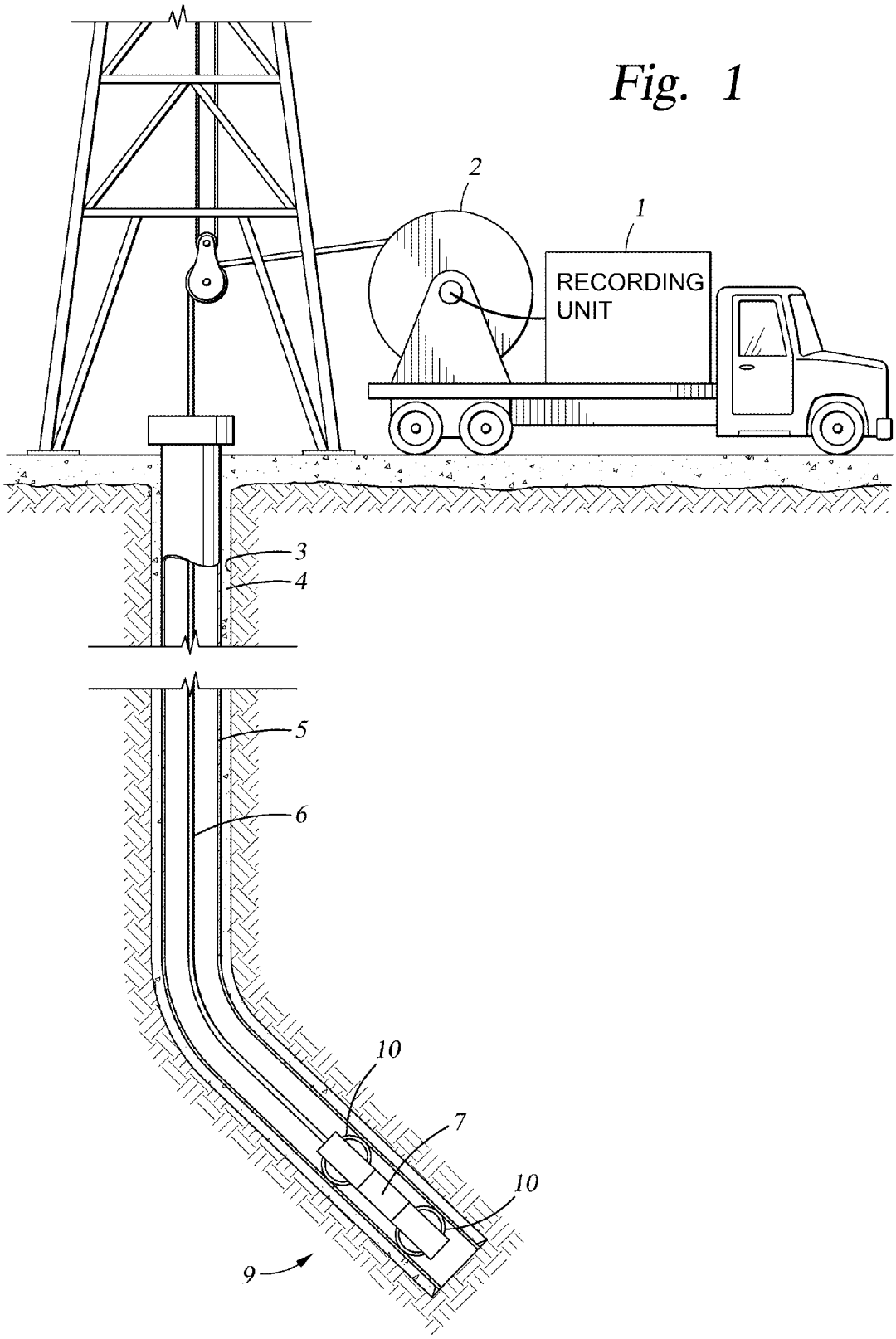
FIG. 1 shows an example well logging instrument being conveyed through a wellbore.

An example well logging instrument is shown in FIG. 1 generally at 9. The instrument 9 may include one or more sensor sections 7, for example, for measuring certain properties of the wellbore 3, a casing 5 disposed in the wellbore 3 and cement 4 that fills the annular space between the casing 5 and the wellbore 3. The instrument 9 can be moved along the interior of the casing 5 by an armored electrical cable 6 of types well known in the art. The cable 6 may be extended into the casing 5 and withdrawn therefrom using a winch 2 or similar spooling device known in the art. Signals generated by the instrument 9, and commands and power to operate the instrument 9 may be conveyed over the cable 6 from a recording unit 1 disposed at the Earth's surface 8. In the present example, the instrument 9 may include two bow spring type centralizers 10, which are used to maintain the position of the instrument 9 in the center of the casing 5 notwithstanding loads such as gravity, as in the deviated part of the wellbore 3 near the bottom thereof as shown in FIG. 1. As explained in the Background section herein, certain types of well logging instruments operate correctly only when substantially centered in the casing 5.

In the present example, the sensor section 7 may be the USI instrument referred to in the Background section herein, however such section is not a limit on the scope of the present invention. Other instruments, for example, those shown at the Uniform Resource Locator:

http://www.slb.com/media/services/production/wellintegrity/cement_bond_logging_tools.pdf may be used in other examples. Although two centralizers 10 are shown in FIG. 1, for the USI instrument described above may use only one such centralizer.

Figure 2:
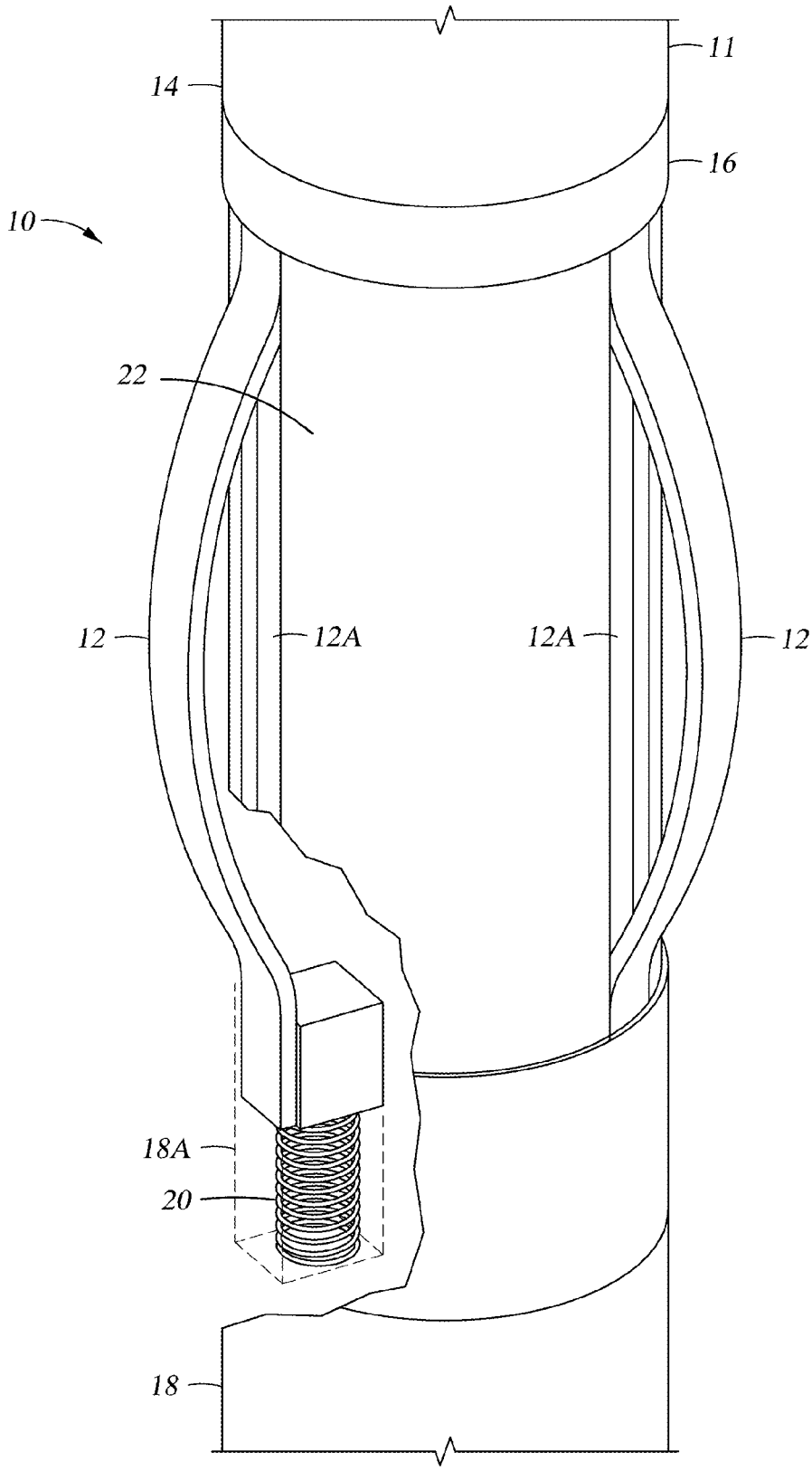
FIG. 2 shows an example centralizer from the instrument of FIG. 1 in more detail.

An example of one of the centralizers for the well logging instrument is shown in more detailed oblique view in FIG. 2. The centralizer 10 may be an integral part of a well logging instrument (9 in FIG. 1) or may be a separate device that can be connected to one or more well logging instruments. The centralizer 10 may be assembled on a generally cylindrical mandrel 11 which includes a fixed spring end 14, a center 22 and a movable spring end 18. The center 22 may in some examples be smaller in diameter than the ends 18, 14, or may include longitudinal slots 12A on the exterior surface for receiving bow springs 12 when the bow springs 12 are fully laterally compressed. The bow springs 12 may be made from spring steel or other resilient material known in the art as typically used for bow springs. The bow springs 12 may be circumferentially evenly distributed about the mandrel 11. A minimum number of bow springs 12 is typically three in order that the forces exerted by the bow springs 12 can cause the mandrel 11 to be urged coaxially with the casing (5 in FIG. 1). Other examples may include four or more such circumferentially distributed bow springs 12. The number of bow springs is therefore not intended to limit the scope of the present invention.

A longitudinal end of each bow spring 12 may be held in a fixed position at the fixed spring end 14, for example by securing with a stop collar 16, by welding to the mandrel 11 or using any other device for affixing the longitudinal spring end to the mandrel 11. The other longitudinal end of each bow spring 12 is free to move longitudinally in relation to the amount of lateral compression of each bow spring 12. For example, movement of the centralizer 10 into a smaller internal diameter pipe or casing would cause such lateral compression and a corresponding longitudinal extension of the bow springs 12. In other examples, both longitudinal ends of the bow spring 12 are free to move longitudinally.

In the present example, the movable longitudinal end of each bow spring 12 is in contact with one end of a biasing device 20 which in the present example may be a coil spring disposed in a corresponding spring pocket 18A in the movable spring end 18 of the mandrel 11. The coil springs 20 are arranged to exert a longitudinal biasing force against the longitudinal end of the corresponding bow spring 12. Thus, each bow spring 12 exerts a larger lateral outward force than a comparable bow spring of equal size, metal thickness, composition and spring temper. It is thus possible to increase the lateral force exerted by the bow springs 12 without the need to increase their number, their size, change their composition or change their free arch. The centralizers 12 can also exert substantial centralization force even when substantially laterally compressed. In such condition, as is known in the art, bow springs may not exert sufficient centralization force to maintain the well logging instrument (9 in FIG. 1) in the center of the casing (5 in FIG. 1). In some examples, both longitudinal ends of the bow springs 12 may be urged into contact with a biasing device, for example the coil springs shown in FIG. 2.

Figure 3:
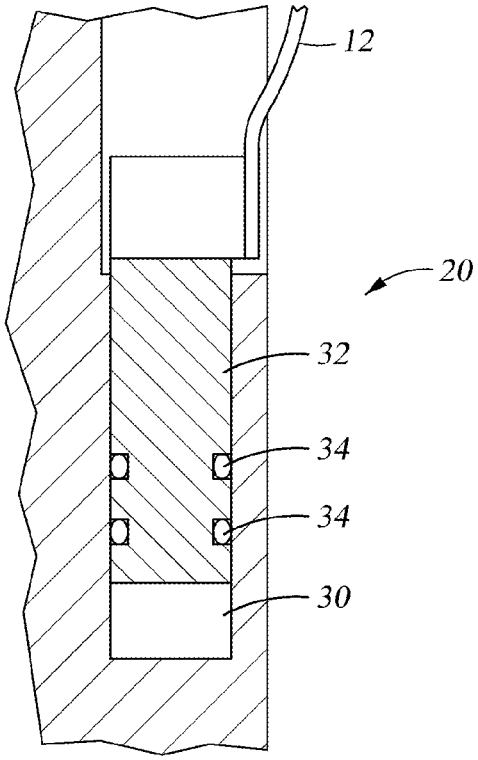
FIG. 3 shows an hydraulic cylinder and piston combination used as a biasing device.
Figure 4:
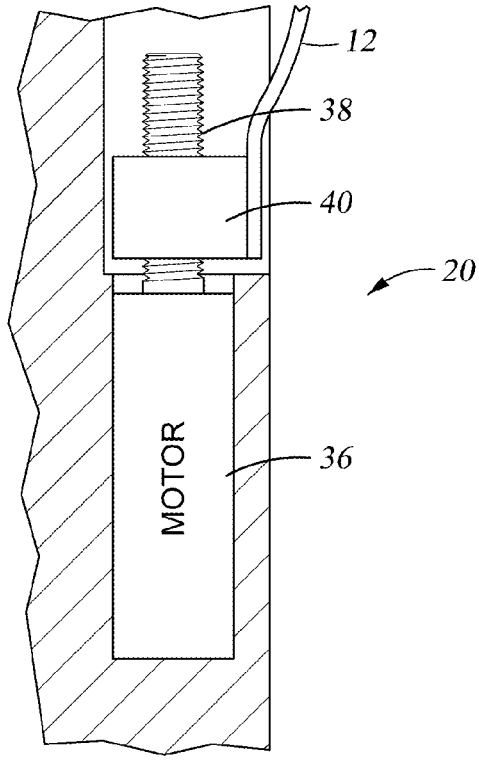
FIG. 4 shows a motor, worm screw and ball nut used as a biasing device.

Referring to FIG. 3, in other examples, the biasing devices 20 may be hydraulic cylinders 30 with pistons 32 therein. The pistons 32 will typically be sealed to the inside of the respective cylinders 30 by o-rings or the like. Application of hydraulic pressure to the underside of the piston 32 will cause it to extend from the cylinder 30, thereby applying longitudinal biasing force to the end of the respective bow spring (12 in FIG. 2).

In other examples, the biasing devices may be motors 36, such as electric or hydraulic motors, arranged to turn respective worm screws 38. The worm screws 38 each cooperatively engage with a ball nut 40 so that rotation of the motor 36 has the effect of moving the ball nut 40 longitudinally. See, for example, U.S. Pat. No. 6,898,994 issued to Operation of the motors 36 may thus be used to change the longitudinal biasing force applied to the bow springs (12 in FIG. 2).

Figure 5:
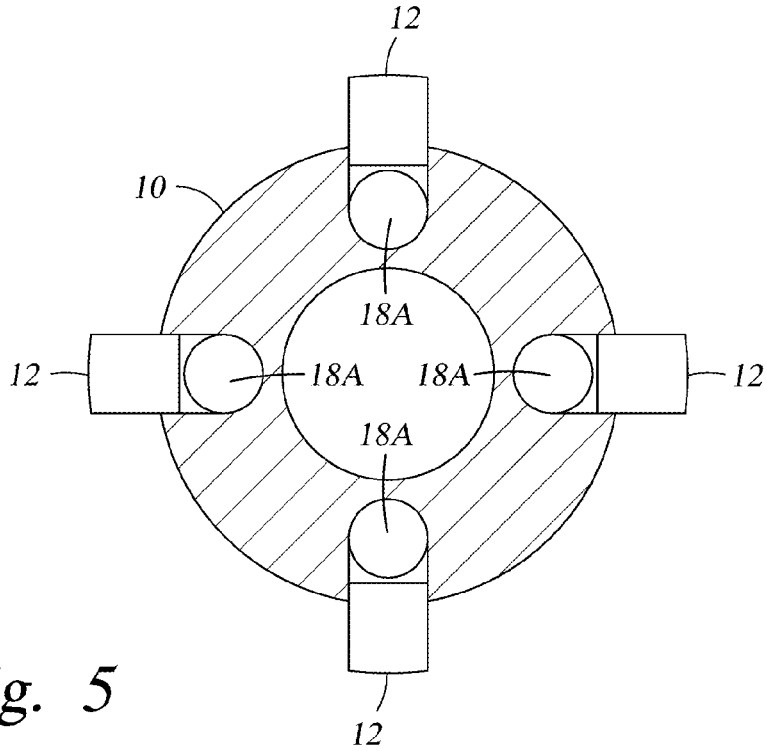
FIG. 5 shows an end view of an example centralizer having four bow springs.

FIG. 5 shows an end view of an example of the centralizer 10 that includes four bow springs 12, four pockets 18A each for receiving a respective biasing device (not shown in FIG. 5) disposed in the center of a wellbore casing 5. As explained above, the number of bow springs in any example is not intended to limit the scope of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A centralizer for a well logging instrument, comprising:

a mandrel;

a plurality of bow springs arranged circumferentially about the exterior surface of the mandrel;

a biasing device in contact with the at least one longitudinal end of each bow spring, the biasing device configured to apply longitudinal biasing force to the longitudinal end of the respective bow spring only when the bow spring is in a laterally compressed position.

2. The centralizer of claim 1, wherein the biasing device comprises a coil spring.

3. The centralizer of claim 1 wherein the biasing device comprises an hydraulic cylinder and piston.

4. The centralizer of claim 1 wherein the biasing device comprises a worm screw and ball nut operatively coupled to a motor.

5. The centralizer of claim 4 wherein the motor comprises at least one of an electric and an hydraulic motor.

6. The centralizer of claim 1 wherein one longitudinal end of each bow spring is maintained at a fixed longitudinal position on the mandrel.

7. The centralizer of claim 1, wherein the bow spring is in a substantially laterally compressed position.

8. The centralizer of claim 1, wherein the bow spring is in a partially laterally compressed position.

9. The centralizer of claim 1, wherein the bow spring exerts a larger lateral outward force when the bow spring is in an extended position than the same bow spring absent the longitudinal biasing force.

10. The centralizer of claim 1, wherein the biasing device is directly in contact with the at least one longitudinal end of each bow spring.

11. A method for well logging, comprising:

moving a well logging instrument along the interior of a wellbore, the well logging instrument including at least one centralizer having a plurality of bow springs disposed circumferentially about the instrument; and applying a longitudinal biasing force to one end of each of the bow springs only when the bow spring is in a laterally compressed position.

12. The method of claim 11 wherein the applying biasing force comprises disposing a coil spring proximate the longitudinal end of the bow spring.

13. The method of claim 11 wherein the applying biasing force comprises extending an hydraulic piston from a cylinder.

14. The method of claim 11 wherein the applying biasing force comprises operating a motor to rotate a worm screw thereby longitudinally moving a ball nut cooperatively engaged to the worm screw.

15. The method of claim 11, further comprising fixing a longitudinal position of one longitudinal end of each bow spring.

16. The method of claim 11, wherein the longitudinal biasing force is a pushing force.

17. A centralizer for a well logging instrument, comprising:

a mandrel;

a number of bow springs arranged circumferentially about the exterior surface of the mandrel; and, a number of biasing devices, wherein:

the number of biasing devices is the same as or more than the number of bow springs; each of the number of biasing devices is associated with only one bow spring; each of the number of biasing devices is in contact with at least one longitudinal end of a bow spring; and, each of the number of biasing devices is configured to apply longitudinal biasing force to the longitudinal end of the respective bow spring when the bow spring is in a laterally compressed position.

* * * * *